US006724233B1

(12) United States Patent
Wittlinger

(10) Patent No.: US 6,724,233 B1
(45) Date of Patent: Apr. 20, 2004

(54) ABSOLUTE VALUE CIRCUIT

(75) Inventor: Harold Allen Wittlinger, Pennington, NJ (US)

(73) Assignee: Intersil Americas Inc., Milpitas, CA (US)

( * ) Notice: Subject to any disclaimer, the term of this patent is extended or adjusted under 35 U.S.C. 154(b) by 0 days.

(21) Appl. No.: 10/379,139

(22) Filed: Mar. 4, 2003

(51) Int. Cl.[7] ..... G06G 7/25
(52) U.S. Cl. ..... 327/354; 327/103
(58) Field of Search ..... 327/103, 354, 327/157; 330/288; 323/315, 316

(56) References Cited

U.S. PATENT DOCUMENTS 3,989,997 A 11/1976 Ahmed ..... 363/140
4,362,956 A * 12/1982 Ogasawara et al. ..... 327/354
4,523,105 A 6/1985 Jose et al. ..... 327/104

* cited by examiner

*Primary Examiner*—Kenneth B. Wells
(74) *Attorney, Agent, or Firm*—Allen, Dyer, Doppelt, Milbrath & Gilchrist, P.A.

(57) ABSTRACT

An absolute value circuit includes an operational amplifier, the output of which is coupled to control inputs of complementary polarity transistors having current flow paths therethrough coupled in series with inputs of current mirror amplifier stages. A common node of the current flow paths through the transistors is coupled to an input of the operational amplifier to which a current waveform is applied. The current mirror amplifier stages are configured so as to provide like polarity output currents. The outputs of the current mirror amplifier stages are combined to produce an output current that corresponds to a full wave rectification or absolute value of an input current coupled to the operational amplifier.

14 Claims, 1 Drawing Sheet

ABSOLUTE VALUE CIRCUIT

FIELD OF THE INVENTION

The present invention relates to rectifier circuits, and is particularly directed to a full wave rectifier or absolute value circuit that provides a comparatively broadband output current that is proportional to the absolute value of input current.

BACKGROUND OF THE INVENTION

It is well known to implement the full wave rectification or absolute value function using a diode bridge. In addition, a number of absolute value circuits employ single and multiple operational amplifier-based architectures. Non-limiting examples of such configurations are found in the U.S. Patents to Ahmed, U.S. Pat. No. 3,989,997 and Jose et al, U.S. Pat. No. 4,523,105. However, neither of these types of circuits provides current-to-current rectification, and they are not necessarily applicable to DC-coupled applications (the Ahmed patent AC-couples the input signal to the rectifier). For many computational circuits, such as true RMS (root mean squared) converters, it is desirable for the absolute value circuit to provide current-to-current rectification.

SUMMARY OF THE INVENTION

In accordance with the present invention, this objective is readily attained by intercoupling a single operational amplifier to a pair of complementary polarity transistors that drive current mirror amplifier stages. The current mirror output stages are configured so as to provide like polarity output currents. The outputs of the current mirror amplifiers are combined so as to produce a composite output current that corresponds to a full wave rectification or absolute value of input current coupled to the operational amplifier. By coupling this full wave rectified current to a load resistor the circuit of the invention produces an output voltage that is the absolute value of an input voltage coupled by way of an input resistor to the operational amplifier.

BRIEF DESCRIPTION OF THE DRAWINGS

The single FIGURE illustrates the circuit configuration of the absolute value circuit in accordance with the invention.

DETAILED DESCRIPTION

Figure 1:
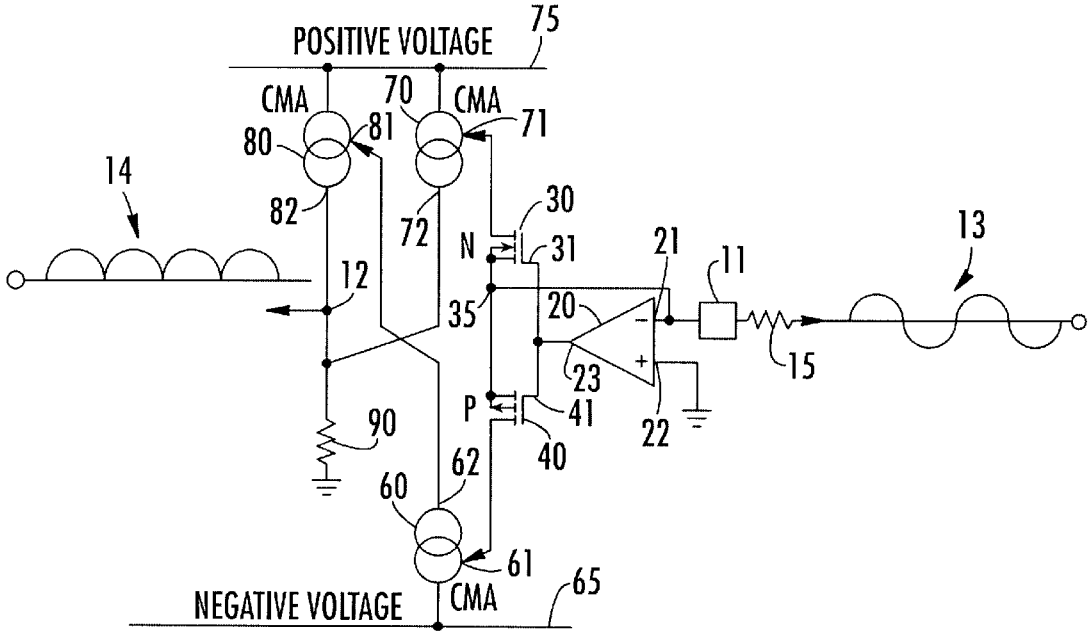

An integrated circuit implementation of the current-based absolute value circuit in accordance with a preferred embodiment of the present invention is shown in FIG. 1 as comprising an input port 11 to which an input voltage waveform 13 is supplied by way of an input resistor 15. The input voltage waveform is converted to an input current waveform by input resistor 15, which may be external to the overall integrated circuit. Input port 11 is coupled to a first, inverting (−) input 21 of an operational amplifier 20, a second, non-inverting (+) input 22 of which is coupled to a prescribed reference potential (e.g., ground).

Input port 11 is further coupled to a common node 35 between a first N-channel field effect transistor (FET) 30 and a second P-channel FET 40, which are operated as linear transistor devices. Coupling input port 11 to node 35 between the two complementary polarity channel FETs allows current to flow either into or out of input port 11. (While transistors 30 and 40 are shown as field effect devices, it is to be understood that alternative equivalent devices, such as bipolar components, may be employed in place thereof, without a loss in generality.)

Operational amplifier 20 has its output 23 coupled to control or gate inputs 31 and 41, respectively, of the FETs 30 and 40, source-drain paths of which are coupled in series between the input 61 of a first current mirror amplifier (or CMA) 60, which is referenced to a negative voltage rail 65, and the input 71 of a second CMA 70, which is referenced to a positive voltage rail 75. Current mirror amplifiers are highly accurate and precisely reflect their input current. As a non-limiting example, the current mirror amplifiers may be configured as a classical Wilson current mirror, or that described in the U.S. Patent to Wittlinger, U.S. Pat. No. 3,835,410. The input/output ratios of the current mirrors may be 1:1, less than 1:1 or greater than 1:1, depending upon the design. CMA 60 has its output 62 coupled to the input 81 of a third CMA 80, which is referenced to the positive voltage rail 65. CMA 80 has its output 82 coupled to an output port 12, shown as being referenced to ground through a load resistor 90. Output port 12 may alternatively be coupled to a current sensitive circuit element, instead of a voltage sensitive device (e.g., resistor). CMA 70 has its output 72 coupled to the output port 12.

The absolute value circuit of the FIGURE operates as follows. In the configuration shown, operational amplifier 20 is connected as a current converter that is referenced to ground. During the positive polarity portion of the input waveform 13, the output 23 of operational amplifier 20 is negative, driving P-channel FET 40 active and tracking the variation of the input waveform, while the N-channel FET 30 is inactive. This allows current to flow from the input port 11 through the source-drain path of P-channel FET 40 to the input port 61 of CMA 60. CMA 60 mirrors the input current waveform applied to its input port 61 as a current flowing into its output 62, which is coupled to the input 81 of CMA 80. The output 82 of CMA 80 thereby mirrors the current flowing out of its input port 81 as a current flowing out of its output port 82, which is coupled to the output port 12 and into load resistor 90. Thus, the voltage waveform produced across load resistor 90 at output port 12 during the positive portion of the input waveform 13 applied to input port 11 exactly tracks the variation in that positive portion.

In a complementary manner, during the negative polarity portion of the input waveform 13, the output 23 of operational amplifier 20 is positive, tracking the negative input voltage variation, and driving N-channel FET 30 active, while P-channel FET 40 is inactive. This allows current to flow out of the input port 71 of CMA 70 through the drain-source path of N-channel FET 30 and into the input port 11. CMA 70 mirrors this current flowing out of its input port 71 as a current waveform flowing out of its output 72, which is coupled directly to the output port 12 and into load resistor 90. Thus, the waveform produced at output port 12 during the negative portion of input waveform 13 applied to input port 11 exactly tracks that negative portion, but has an opposite or positive polarity.

With the outputs 72 and 82 of respective current mirror amplifiers 70 and 80 being summed together via load resistor 90 coupled to output port 12, the output voltage waveform 14 produced at output port 12 is a full wave rectification or absolute value of the input voltage waveform 13 applied to input port 11. As the summation waveform coupled from CMAs 70 and 80 to the output port 12 is a current, it may be readily directly applied to other current-based circuits, such as operational amplifiers.

While I have shown and described an embodiment in accordance with the present invention, it is to be understood that the same is not limited thereto but is susceptible to numerous changes and modifications as known to a person skilled in the art. I therefore do not wish to be limited to the details shown and described herein, but intend to cover all such changes and modifications as are obvious to one of ordinary skill in the art.

What is claimed is:

1. A circuit for producing an output current waveform representative of the absolute value of an input current waveform comprising:

an input port to which said input current waveform is coupled;

an output port from which said output current waveform is derived;

an operational amplifier having an input coupled to said input port and an output;

a first current mirror circuit referenced to a first voltage and having an input and an output;

a second current mirror circuit referenced to a second voltage and having an input and an output;

a third current mirror circuit referenced to said first voltage and having an input and an output;

first and second transistor devices having current flow paths therethrough coupled in series between the input of said first current mirror circuit and the input of said second current mirror circuit, and wherein control ports of said first and second transistor devices are coupled to the output of said operational amplifier; and wherein the outputs of said first and third current mirror circuits are coupled to said output port; and the output of said second current mirror circuit is coupled to the input of said third current mirror circuit.

2. The circuit according to claim 1, wherein the input of said operational amplifier is coupled to said current flow paths through said first and second transistor devices.

3. The circuit according to claim 1, wherein the input of said operational amplifier is coupled to a common connection of said first and second transistor devices.

4. The circuit according to claim 1, wherein said first and second transistor devices are complementary polarity transistors.

5. The circuit according to claim 1, wherein said output port is coupled through an output resistor to a prescribed reference potential.

6. The circuit according to claim 5, wherein said reference potential is between said first and second voltages.

7. The circuit according to claim 1, wherein the input of said operational amplifier is coupled through an input resistor to said input port.

8. The circuit according to claim 1, wherein said current mirror circuits comprise current mirror amplifiers.

9. A method of generating an output current waveform representative of the absolute value of an input current waveform comprising the steps of:

(a) coupling said input current waveform to an operational amplifier and to the current flow path of first and second complementary transistor devices, coupled in series between inputs of first and second current mirror circuits referenced to opposite polarity voltages;

(b) coupling an output of said operational amplifier to control inputs of said first and second complementary transistor devices;

(c) coupling an output of one of said first and second current mirror circuits to a third current mirror circuit referenced to one of said opposite polarity voltages; and (d) combining an output of another of said first and second current mirror circuits and an output of said third current mirror circuit, to produce said output current waveform.

10. The method according to claim 9, wherein step (a) comprises coupling said input of said operational amplifier to a common connection of said first and second transistor devices.

11. The method according to claim 9, wherein said first and second transistor devices are complementary polarity field effect transistors.

12. The method according to claim 9, wherein said output port is coupled through an output resistor to a prescribed reference potential so as to develop an output voltage representative of the absolute value of said input current waveform.

13. The method according to claim 1, wherein the input of said operational amplifier is coupled through an input resistor to an input voltage having a waveform from which said input current waveform is produced.

14. The method according to claim 9, wherein said current mirror circuits comprise current mirror amplifiers.

* * * * *